US010539125B2

(12) United States Patent
Chang

(10) Patent No.: US 10,539,125 B2
(45) Date of Patent: Jan. 21, 2020

(54) MANUAL PUMP

(71) Applicant: Chi-Yuan Chang, Taichung (TW)

(72) Inventor: Chi-Yuan Chang, Taichung (TW)

( * ) Notice: Subject to any disclaimer, the term of this patent is extended or adjusted under 35 U.S.C. 154(b) by 293 days.

(21) Appl. No.: 15/488,465

(22) Filed: Apr. 15, 2017

(65) Prior Publication Data

US 2018/0298889 A1 Oct. 18, 2018

(51) Int. Cl.

| | |
|---|---|
| ***F04B 33/00*** | (2006.01) |
| ***F04B 53/10*** | (2006.01) |
| ***F04B 53/14*** | (2006.01) |
| ***F04B 39/10*** | (2006.01) |
| ***F04B 39/12*** | (2006.01) |

(52) U.S. Cl.

CPC ..... *F04B 33/00* (2013.01); *F04B 39/1013* (2013.01); *F04B 39/121* (2013.01); *F04B 39/123* (2013.01); *F04B 53/10* (2013.01); *F04B 53/143* (2013.01)

(58) Field of Classification Search

CPC ..... F04B 33/00; F04B 45/00; F04B 45/02; F04B 43/0063; F04B 53/10; F04B 53/143; F04B 39/1013; F04B 39/121

See application file for complete search history.

(56) References Cited

U.S. PATENT DOCUMENTS 2,701,672 A * 2/1955 Glasco ..... A63H 27/10 141/313
2,954,048 A * 9/1960 Rychlik ..... F04B 43/0063 137/512.15
5,074,765 A * 12/1991 Pekar ..... F04B 45/04 36/29
5,226,793 A * 7/1993 Stovall ..... F04B 33/00 417/437
5,257,470 A * 11/1993 Auger ..... A43B 23/029 36/114
5,846,063 A * 12/1998 Lakic ..... A42B 3/122 417/440
7,950,909 B2 * 5/2011 Chang ..... F04B 45/02 417/480
8,105,056 B2 * 1/2012 Chan ..... F04B 33/00 137/848
2008/0041457 A1 * 2/2008 Huang ..... F04B 33/00 137/226

(Continued)

FOREIGN PATENT DOCUMENTS

EP 0152401 A2 * 8/1985 ..... A43B 5/0407
GB 2480702 A * 11/2011 ..... F04B 33/00

*Primary Examiner* — Nathan C Zollinger

(57) ABSTRACT

A manual pump includes a pumping unit and a nozzle unit. The pumping unit includes an air bag, a valve housing connected to the air bag, and a sealing ring located on and around the valve housing. The nozzle unit includes a shell connected to an inflatable object and made with an opening, a shield connected to the shell and made with an aperture, a plunger inserted in the opening and the aperture, a sealing ring located on and around the plunger, and a spring located on and around the plunger and compressed between the plunger and the shield. The aperture is in communication of air with the opening, and the opening includes a tapered portion with a wall in contact with the sealing ring of the pumping unit when the valve housing is inserted in the shell.

14 Claims, 12 Drawing Sheets

(56) References Cited

U.S. PATENT DOCUMENTS

| | | | | |
|---|---|---|---|---|
| 2012/0157249 | A1* | 6/2012 | Yeh | A63B 41/085<br>473/604 |
| 2016/0310801 | A1* | 10/2016 | Yeh | F04B 45/04 |
| 2017/0107980 | A1* | 4/2017 | Liu | F04B 39/10 |

* cited by examiner

MANUAL PUMP

BACKGROUND OF INVENTION

1. Field of Invention

The present invention relates to a manual pump and, more particularly, to a sealing apparatus for a manual pump.

2. Related Prior Art

Referring to FIG. 12, a conventional manual pump includes a pumping unit 90 and a nozzle unit 80. The nozzle unit 80 is secured to an inflatable object (not shown). The pumping unit 90 includes an air bag 91 connected to a valve housing 92. The nozzle unit 80 includes a shell 81, a shield 82, a plunger 83, a sealing ring 84, a spring 85 and a gasket 86. The shell 81 includes an opening 811. The shield 82 includes an aperture 821. The shield 82 is connected to the shell 81. The plunger 83 is inserted in the opening 811 and the aperture 821. The sealing ring 84 is located around an end of the plunger 83. The spring 85 is located around the plunger 83 and compressed between the shield 82 and an enlarged end of the plunger 83. The gasket 86 is inserted in the opening 811.

In operation, the valve housing 92 of the pumping unit 90 is inserted in the opening 821 of the shell 82 of the nozzle unit 80. The valve housing 92 is pressed against the gasket 86. Thus, it is air-tight between the periphery of the valve housing 92 and the wall of the opening 821.

As mentioned above, the valve housing 92 is pressed against the gasket 86 for sealing purposes. However, there are problems with this arrangement.

Firstly, the valve housing 92 is rotated relative to the shell 81 after the valve housing 92 is inserted in the opening 811 of the shell 81 so that they are connected to each other. If the gasket 86 is too thick, it would be difficult to rotate the valve housing 92 relative to the shell 81, and the gasket 86 would be worn away. On the contrary, if the gasket 86 is too thin, the sealing effect would be poor.

Secondly, the gasket 86 suffers undesirable deformation because of compression and twisting by the valve housing 92 and/or aging. Hence, there is variation of pressure at the interface between the valve housing 92 and the gasket 86, and the sealing effect is poor.

Thirdly, the inflatable object is closed, and there is air pressure in it after air is pumped into it from the pumping unit 90. Some of the air might return to the pumping unit 90 from the inflatable object via the nozzle unit 80, which is made of plastics, and the nozzle unit 80 could suffer undesirable deformation. The valve housing 92 of pumping unit 90 might be moved away from the nozzle unit 80 a little because of the undesirable deformation of the nozzle unit 80. Hence, the sealing effect is jeopardized.

The present invention is therefore intended to obviate or at least alleviate the problems encountered in prior art.

SUMMARY OF INVENTION

It is the primary objective of the present invention to provide an effective and efficient manual pump.

To achieve the foregoing objective, the manual pump includes a pumping unit and a nozzle unit. The pumping unit includes an air bag, a valve housing connected to the air bag, and a sealing ring located on and around the valve housing. The nozzle unit includes a shell connected to an inflatable object and made with an opening, a shield connected to the shell and made with an aperture, a plunger inserted in the opening and the aperture, a sealing ring located on and around the plunger, and a spring located on and around the plunger and compressed between the plunger and the shield. The aperture is in communication of air with the opening, and the opening includes a tapered portion with a wall in contact with the sealing ring of the pumping unit when the valve housing is inserted in the shell.

Other objectives, advantages and features of the present invention will be apparent from the following description referring to the attached drawings.

BRIEF DESCRIPTION OF DRAWINGS

The present invention will be described via detailed illustration of two embodiments versus the prior art referring to the drawings wherein.

DETAILED DESCRIPTION OF EMBODIMENTS

Figure 1:
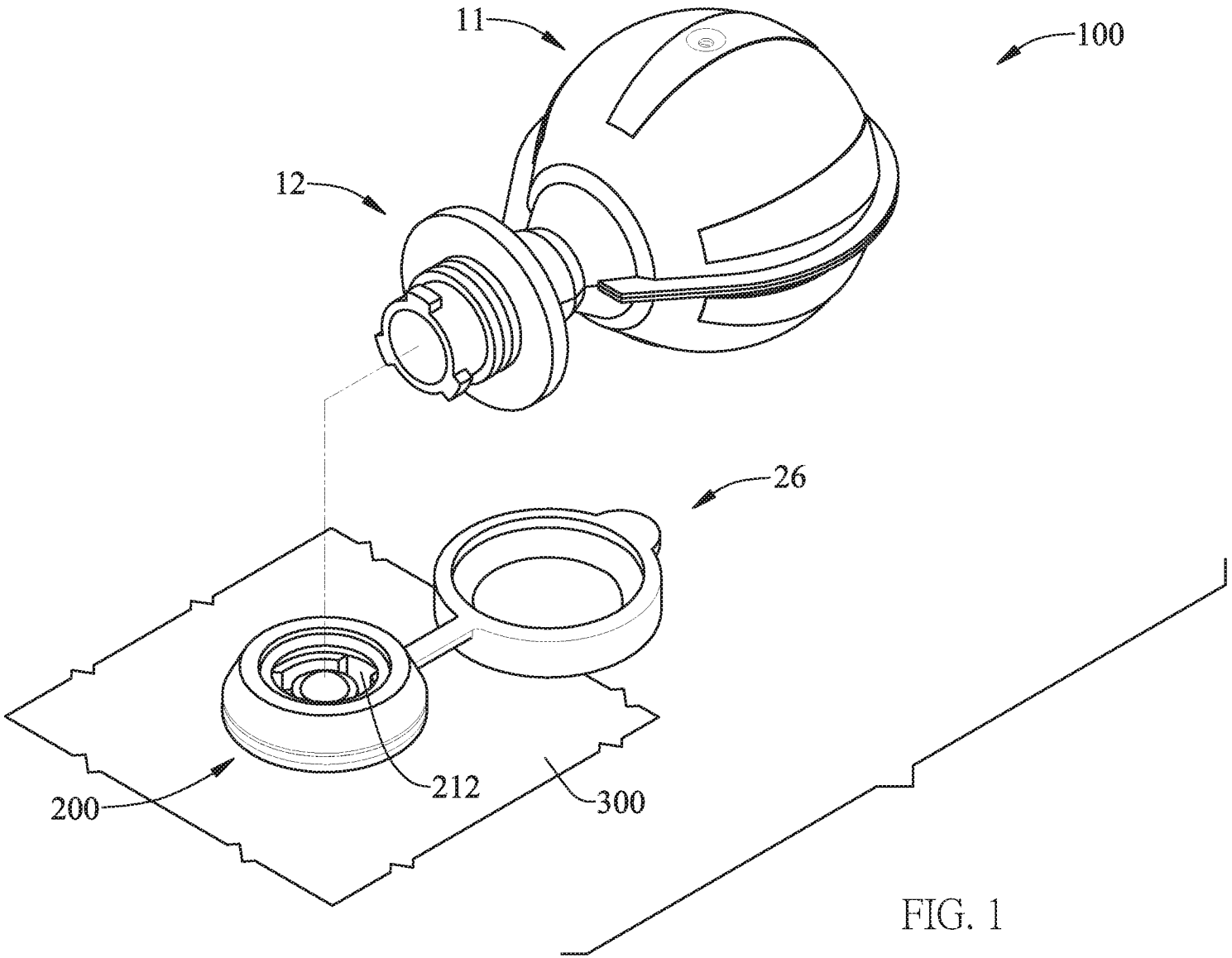
FIG. 1 is a perspective view of a manual pump according to the first embodiment of the present invention.

Referring to FIGS. 1 to 5 and 7, a manual pump includes a pumping unit 100 and a nozzle unit 200 according to a first embodiment of the present invention. The nozzle unit 200 is connected to an inflatable object 300 so that they are in communication of air with each other. In use, the pumping unit 100 is engaged with the nozzle unit 200 so that air can be pumped into the inflatable object 300 from the pumping unit 100 via the nozzle unit 20. The air can be released from the inflatable object 300 via the nozzle 20.

Figure 2:
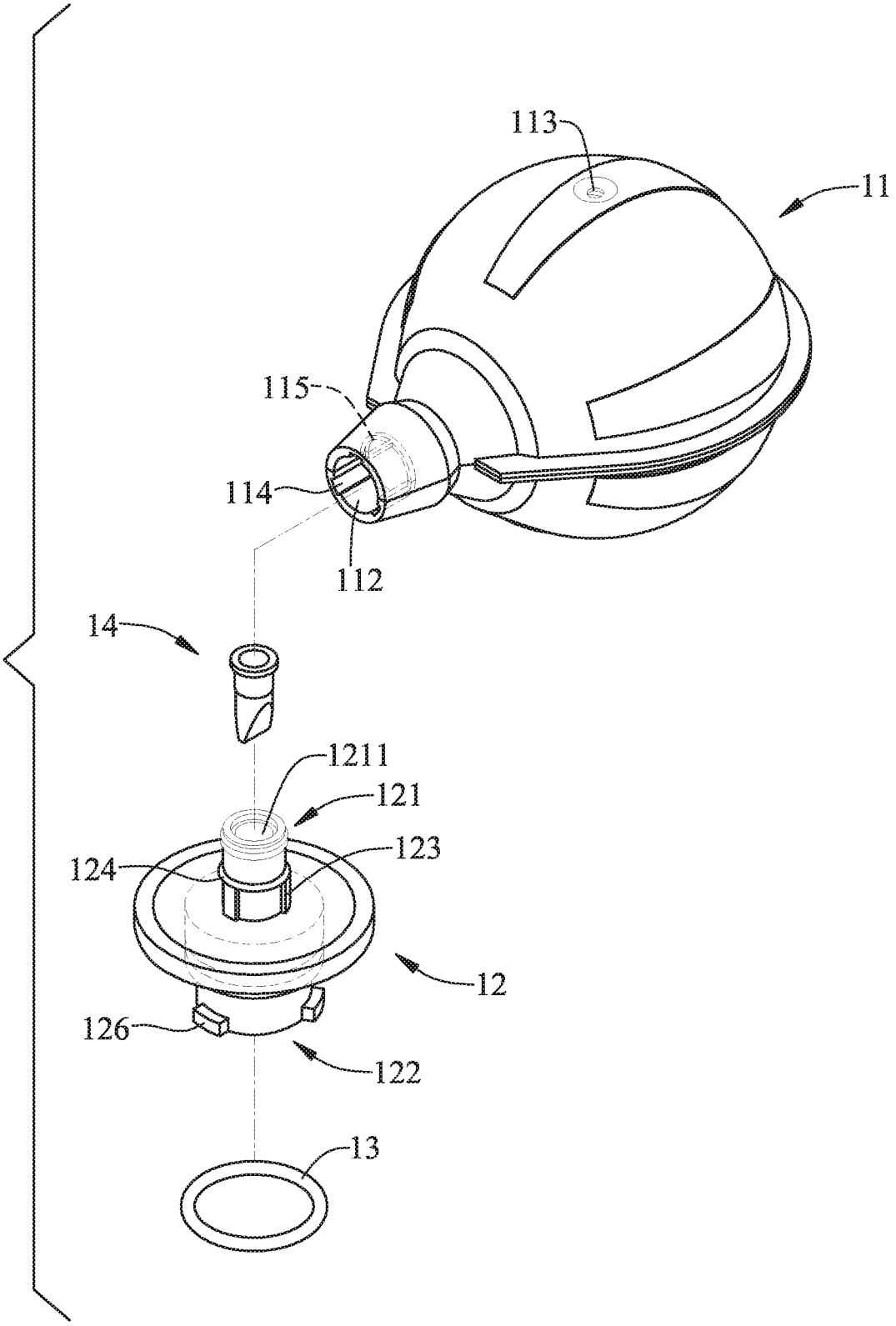
FIG. 2 is an exploded view of a pumping unit of the manual pump shown in FIG. 1.
Figure 7:
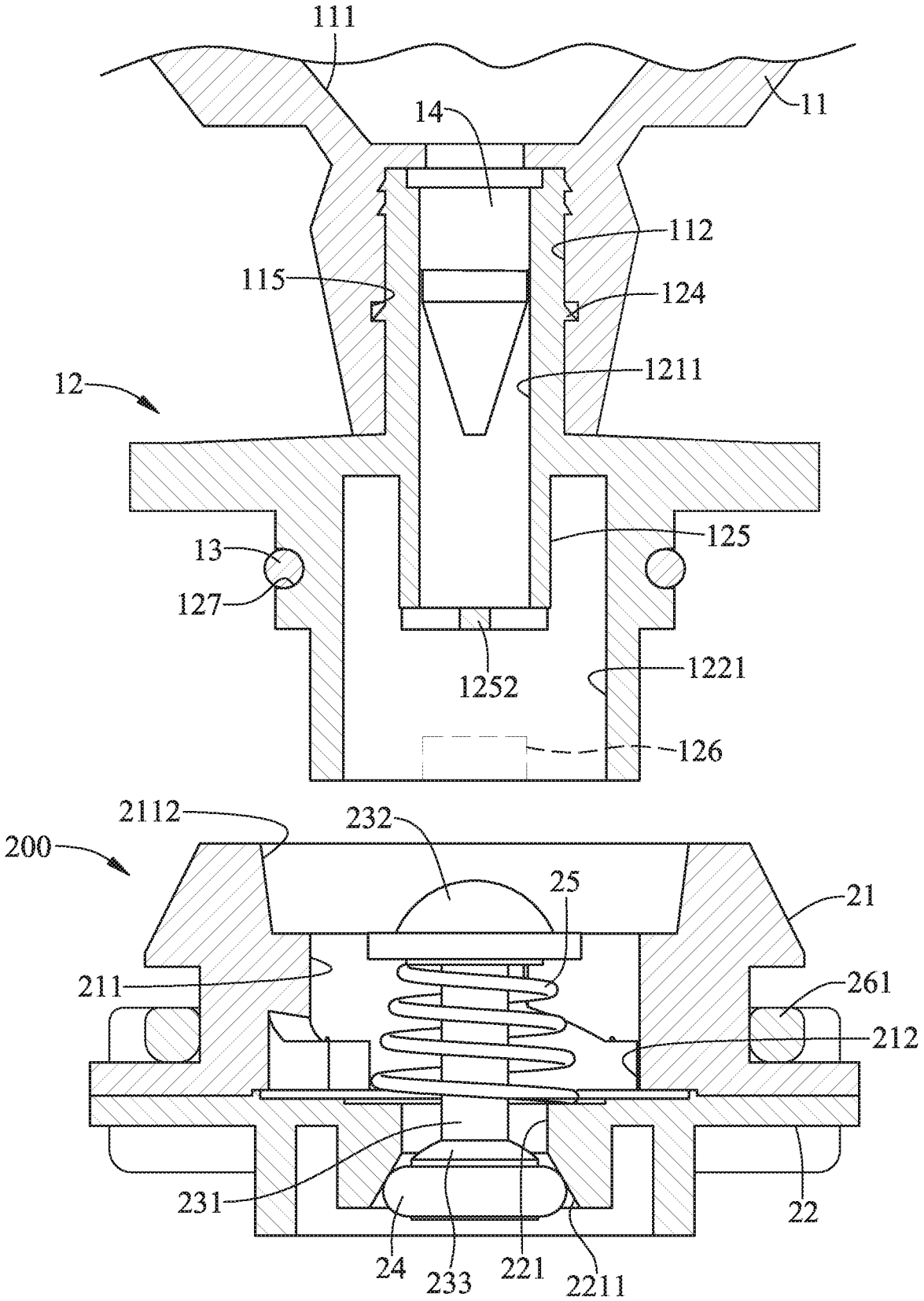
FIG. 7 is a cross-sectional view of the manual pump shown in FIG. 1.

Referring to FIGS. 1, 2 and 7, the pumping unit 100 includes an air bag 11, a valve housing 12, a sealing ring 13 and a check valve 14. The air bag 11 is made of an elastic material so that it is compressible. The air bag 11 includes a chamber 111, an exit 112, an entrance 113, at least one rectilinear groove 114 and at least one annular groove 115. The chamber 111 is made in the air bag 11. The chamber 111 is in communication of air with the exterior of the air bag 11 via the entrance 112 and the entrance 113. Air can be introduced into the air bag 11 through the entrance 113. The air can be released from the air bag 11 via the exit 112. There are preferably several rectilinear grooves 114. The rectilinear grooves 114 and the annular groove 115 are made in the wall of the exit 112. The rectilinear grooves 114 extend from an external end of the exit 112 in an axial sense of direction of the exit 112. The annular groove 115 is in communication of air with an end of each of the rectilinear grooves 114.

Referring to 1, 2, 3, and 7, the valve housing 12 includes a connective portion 121, a tubular insert 122, at least one rectilinear rib 123, at least one annular rib 124, a pushing tube 125, several arched ribs 126, and an annular groove 127. The connective portion 121 extends from an end of the valve housing 12. The tubular insert 122 and the pushing tube 125 extend from an opposite end of the valve housing 12. The connective portion 121 includes a channel 1211. The tubular insert 122 includes a bore 1221. The connective portion 121 is inserted in the exit 112, thereby connecting the air bag 11 to the valve housing 12. There are preferably several rectilinear ribs 123 formed on an external face of the connective portion 121 corresponding to the rectilinear grooves 114 of the air bag 11. The annular rib 124 is formed on the external face of the connective portion 121 corresponding to the annular groove 115 of the air bag 11. The pushing tube 125 co-axially extends in the bore 1221 of the tubular insert 122. The pushing tube 125 includes several crossbars 1252 formed at a free end. The arched ribs 126 are evenly located on an external face of the tubular insert 122, near a free end of the tubular insert 122. The annular groove 127 is made in the external face of the tubular insert 122 and used to receive the sealing ring 13.

Figure 3:
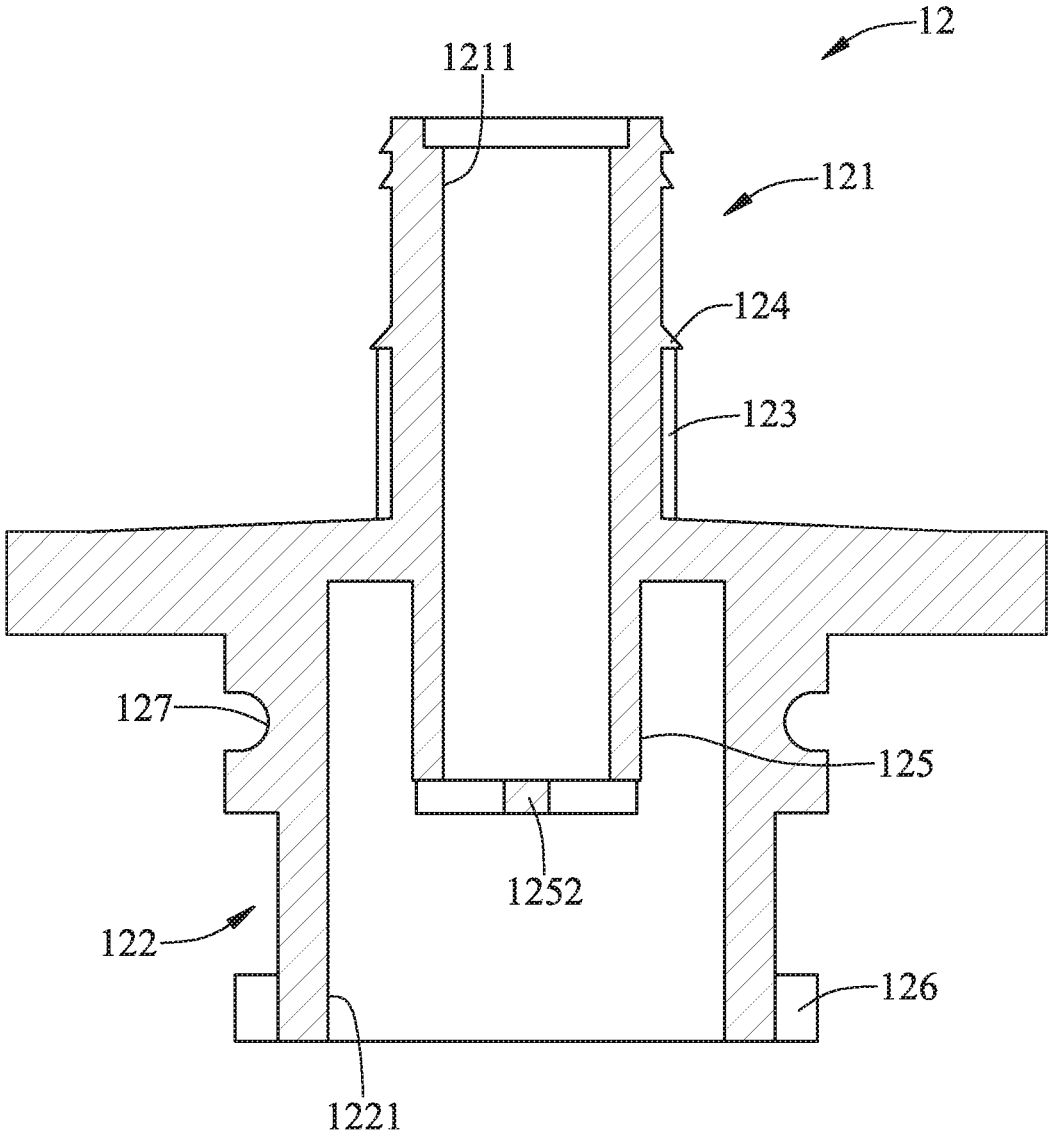
FIG. 3 is an enlarged, partial, cross-sectional view of the pumping unit shown in FIG. 2.

Referring to FIGS. 2, 3 and 7, the check valve 14 is inserted in the channel 1211 of the connective portion 121 of the valve housing 12. The check valve 14 is a tubular element made of an elastic material so that it is deformable. An end of the check valve 14 is always open. An opposite end of the check valve 14 is normally closed and can be opened. The check valve 14 is conventional and hence will not be described in detail.

Referring to FIGS. 1, 4, 5 and 7, the nozzle unit 200 includes a shell 21, a shield 22, a plunger 23, a sealing ring 24, a spring 25, and a covering element 26. The shell 21 includes an opening 211 and several arched grooves 212. The opening 211 extends throughout the shell 21 corresponding to the tubular insert 122 of the valve housing 12. The opening 211 includes, at an end, a tapered portion 2112 for cooperation with the sealing ring 13, which is inserted in the annular groove 127. The arched grooves 212 are made in the wall of the opening 211 corresponding to the arched ribs 126 of the tubular insert 122 of the valve housing 12.

Figure 4:
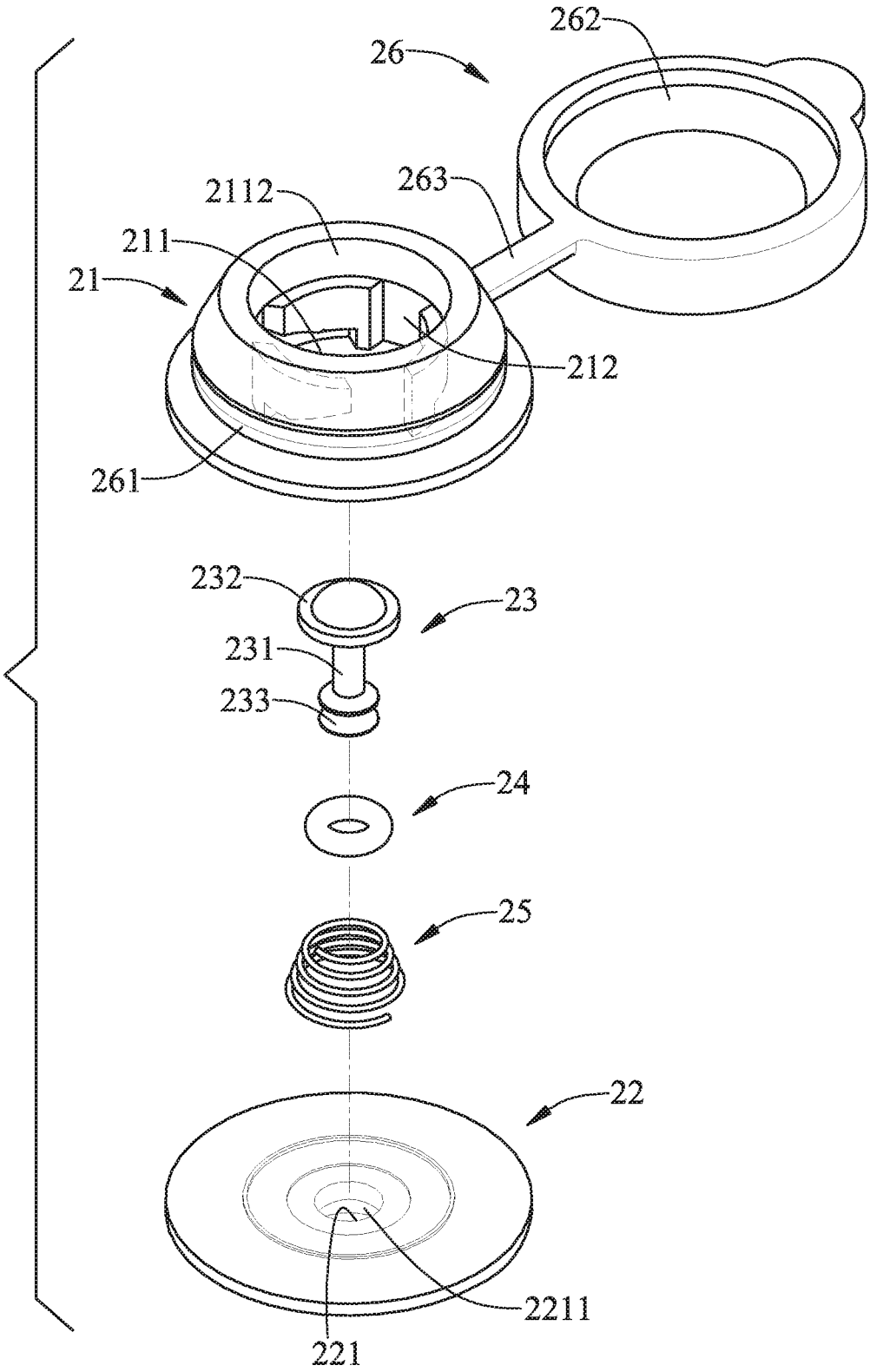
FIG. 4 is an exploded view of a nozzle unit of the manual pump shown in FIG. 1.
Figure 5:
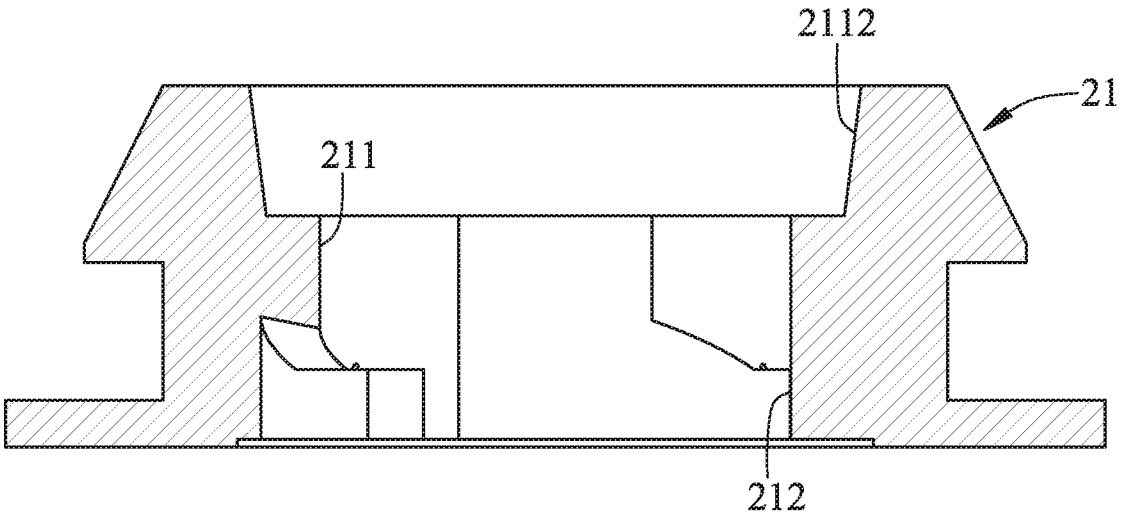
FIG. 5 is an enlarged, partial, cross-sectional view of the nozzle unit shown in FIG. 4.
Figure 6:
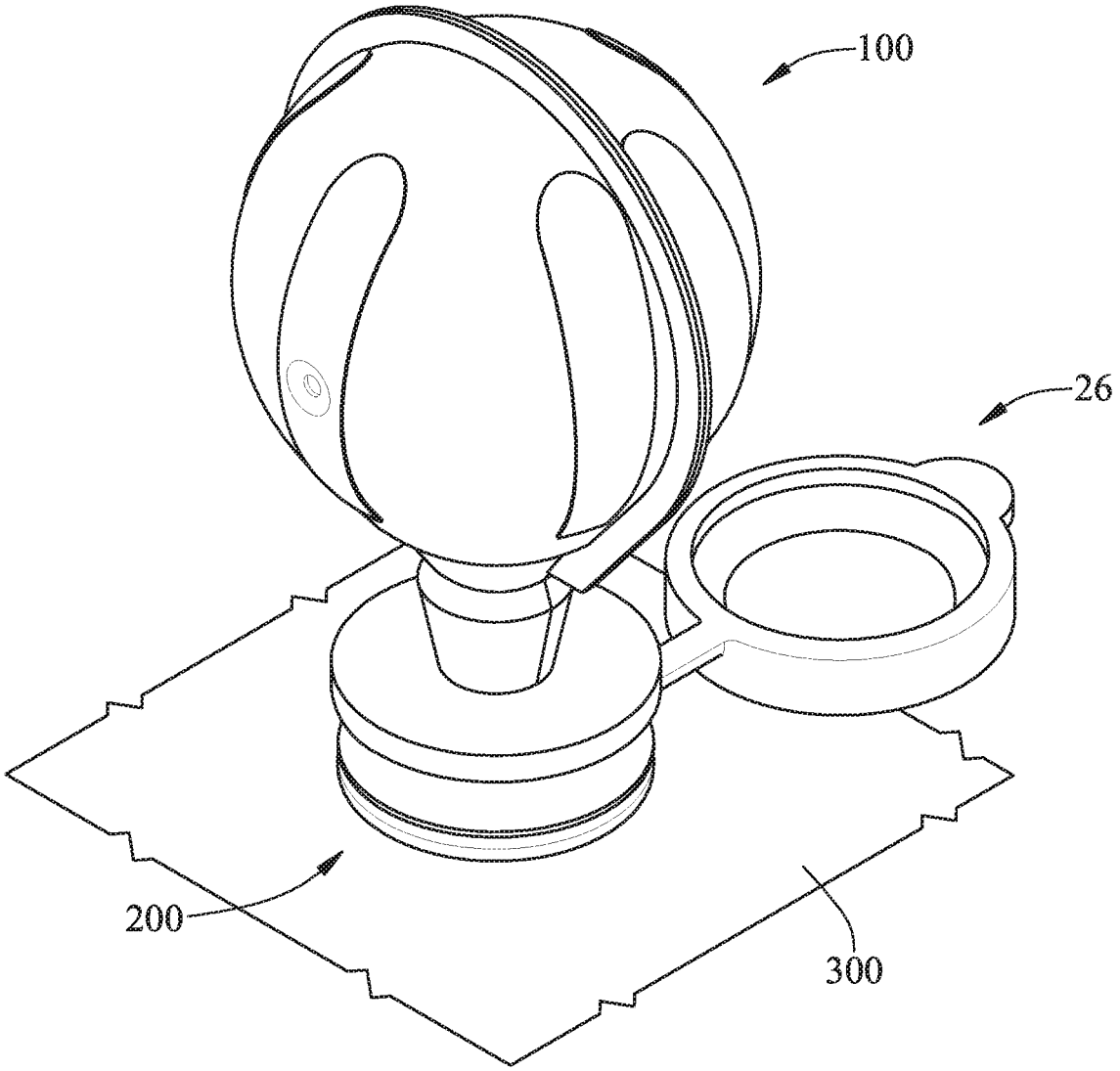
FIG. 6 is a perspective view of the manual pump in another position than shown in FIG. 1.

Referring to FIGS. 4, 5 and 7, the shield 22 includes an aperture 221 corresponding to an end of the shell 21. The aperture 221 extends throughout the shield 22. The aperture 221 is coaxial with the channel 211 of the shell 21 when the shield 22 is connected to the shell 21. The aperture 221 includes a tapered portion 2211 at a lower end.

Figure 8:
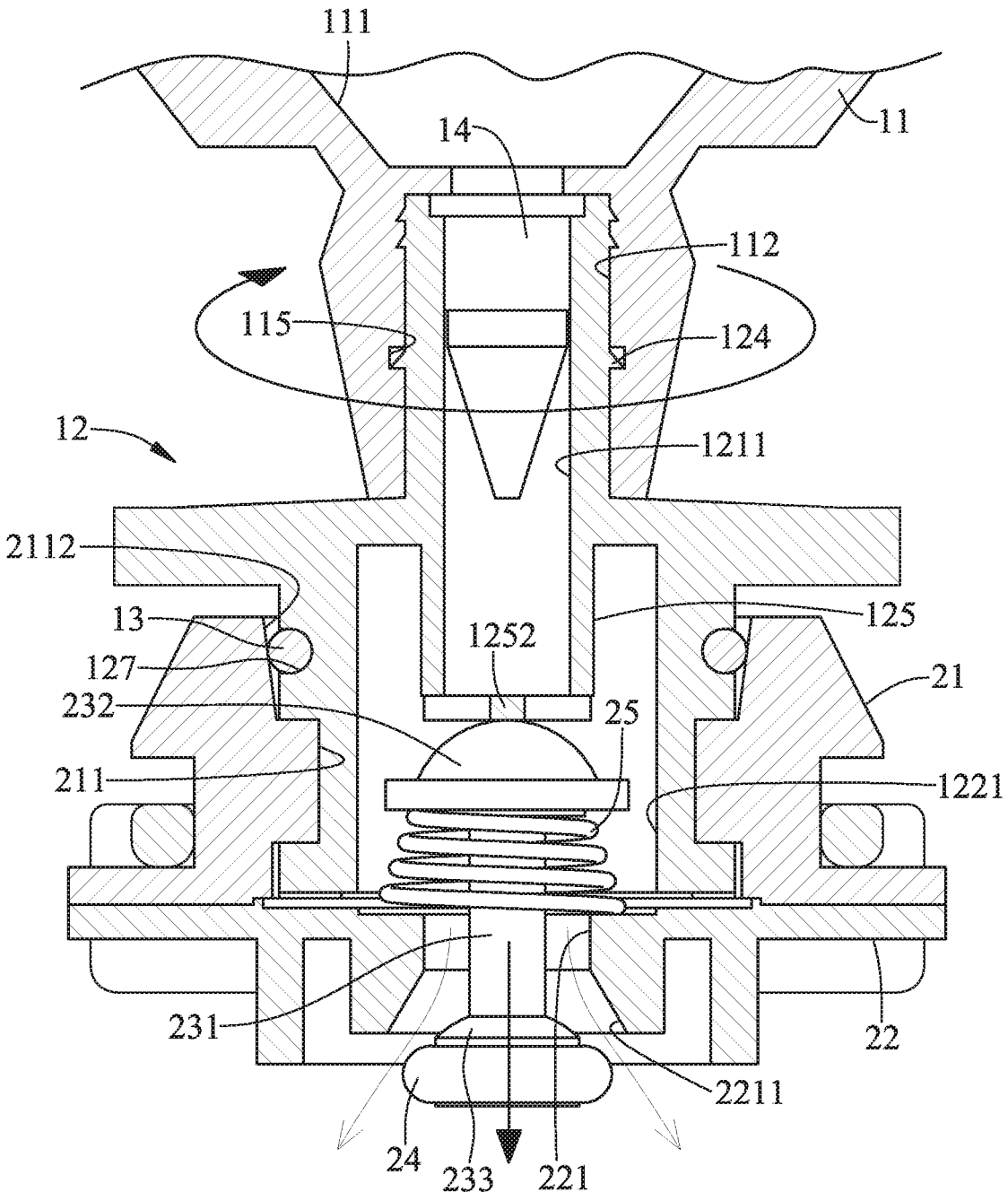
FIG. 8 is a cross-sectional view of the manual pump in another position than shown in FIG. 7.

Referring to FIGS. 4 and 7, the plunger 23 is movable in the opening 211 and the aperture 221 between an opening position (FIG. 8) and a closing position (FIG. 7). The plunger 23 includes a middle section 231 formed between two enlarged ends 232 and 233. The enlarged end 232 is inserted in the opening 211. The diameter of the enlarged end 232 is larger than that of the aperture 221. The enlarged end 233 is inserted in the aperture 221. The sealing ring 24 is located on and around the enlarged end 233. The enlarged end 233 and the sealing ring 24 are used to close the tapered portion 2211 of the aperture 221.

The spring 25 is located around and on the middle section 231 and compressed between the enlarged end 232 and the shield 22. Thus, the plunger 23 is kept in the closing position (FIG. 7).

Referring to FIGS. 1, 4 and 7, the covering element 26 includes a ring 261, a cap 262 and a linking strip 263. The ring 261 is formed at an end of the linking strip 263 while the cap 262 is formed at another end of the linking strip 263. The ring 261 is located on and around the shell 21. The ring 261 is preferably inserted in an annular groove (not numbered) made in the periphery of the shell 21. The cap 262 is used to close the shell 21. The cap 262 includes a frusto-conical contact face (no numbered) for tight contact with a frusto-conical contact face (not numbered) of the shell 21.

Referring to FIGS. 6 to 10, to inflate the inflatable object 300, the tubular insert 122 of the valve housing 12 of the pumping unit 100 is inserted in the opening 211 of the shell 21 of the nozzle unit 200. Then, the valve housing 12 is rotated relative to the shell 21 to insert the arched ribs 126 of the valve housing 122 in the arched grooves 212 of the shell 21. Thus, the pumping unit 100 is firmly connected to the nozzle unit 200. During the tubular insertion of the tubular insert 122 into the opening 211, the crossbars 1252 of the pushing tube 125, which extends in the bore 1221, is pressed against the first enlarged end 232 of the plunger 23, thereby moving the plunger 23 from the closing position (FIG. 7) to the opening position (FIG. 8) where the enlarged end 233 and the sealing ring 24 are removed from the wall of the tapered portion 2211 of the aperture 221 of the shield 22.

As the plunger 23 is in the opening position, the sealing ring 13, which is located on and around the tubular insert 122, is pressed against the wall of the tapered portion 2112 of the opening 211 of the shell 21. Thus, it is air-tight between the periphery of the tubular insert 122 of the valve housing 12 and the wall of the opening 211 of the shell 21 via the sealing ring 13. As the tubular insert 122 of the valve housing 12 is inserted deeper in the opening 211 of the shell 21, the air-tightness between the periphery of the tubular insert 122 of the valve housing 12 and the wall of the opening 211 of the shell 21 via the sealing ring 13 gets better.

Figure 9:
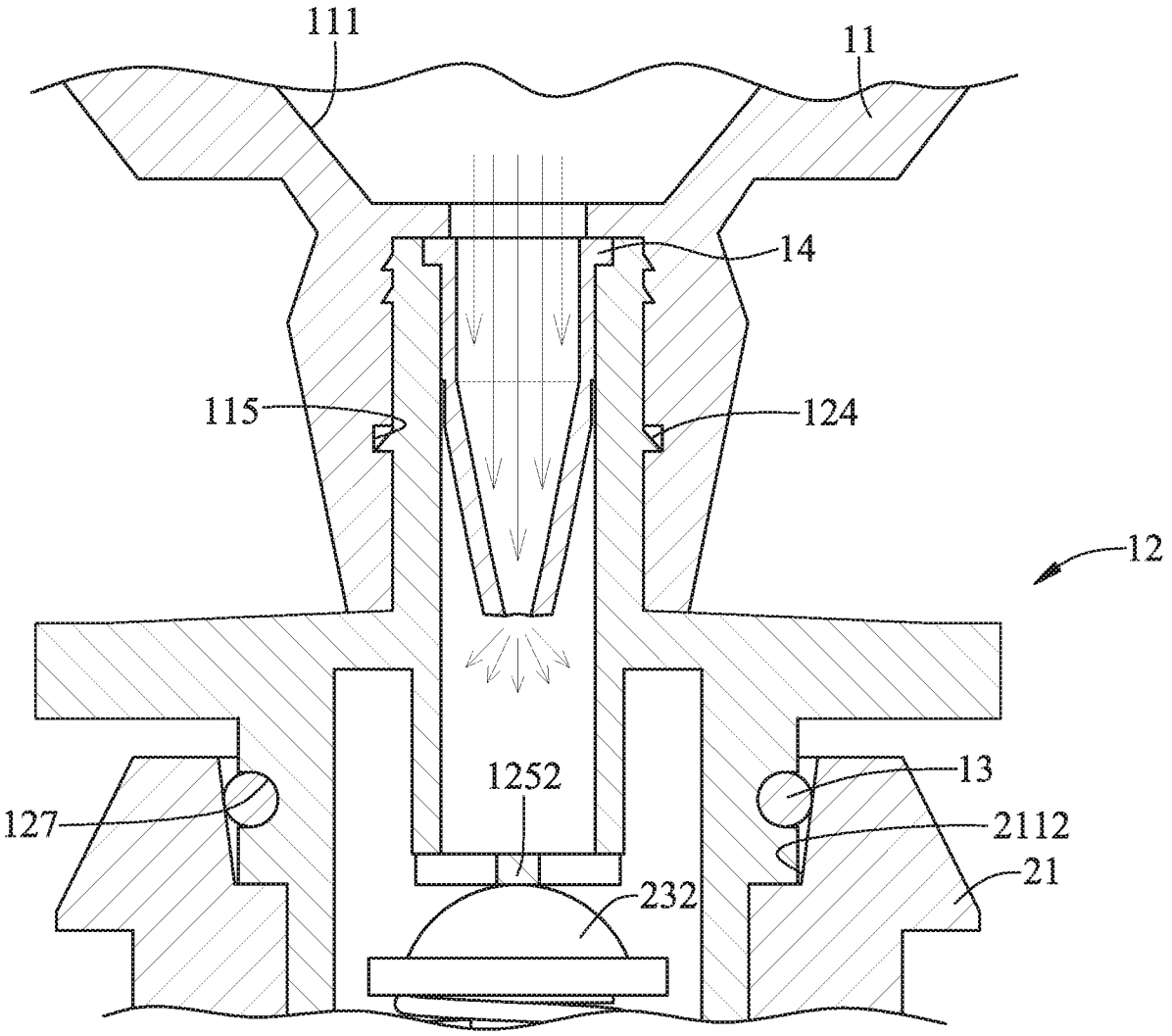
FIG. 9 is an enlarged, partial view of the manual pump shown in FIG. 8.

Now, referring to FIG. 9, a user is allowed to compress the air bag 11 to pump air from the chamber 111 of the air bag 11 into the shell 21 through the channel 1211 of the valve housing 12, the check valve 14 and the bore 1221, and further into the inflatable object 300 via the opening 211 and the aperture 221 of the shield 22.

Figure 10:
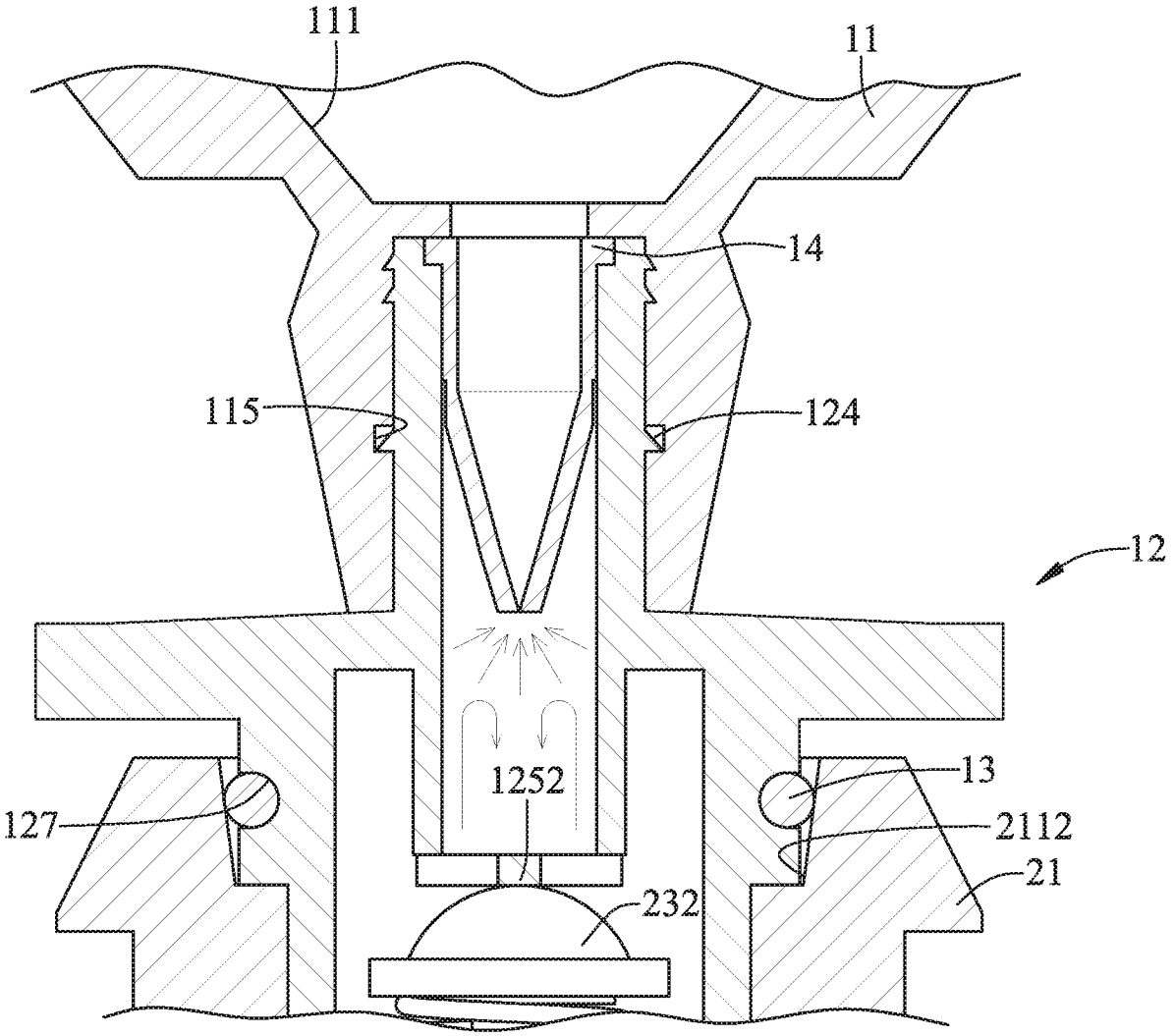
FIG. 10 is an enlarged, partial, cross-sectional view of the manual pump in another position than shown in FIG. 9.

Then, referring to FIG. 10, the user releases the air bag 11 to allow the air bag 11 to expand to allow more air to enter the air bag 11 via the entrance 113. During the expansion of the air bag 11, air cannot return into the air bag 11 from the inflatable object 300 for the use of the check valve 14.

The above-mentioned process is repeated to fill the inflatable object 300 with a desired amount of air. Then, the pumping unit 100 is disengaged from the nozzle unit 200, and the plunger 23 is not pushed by the pushing tube 125 of the valve housing 122, but biased by the spring 25 so that plunger 23 is moved from the opening position (FIG. 8) to the closing position (FIG. 7) where the enlarged end 233 and the sealing ring 24 are in contact with the wall of the tapered portion 2211 of the aperture 221 of the shield 22.

Figure 11:
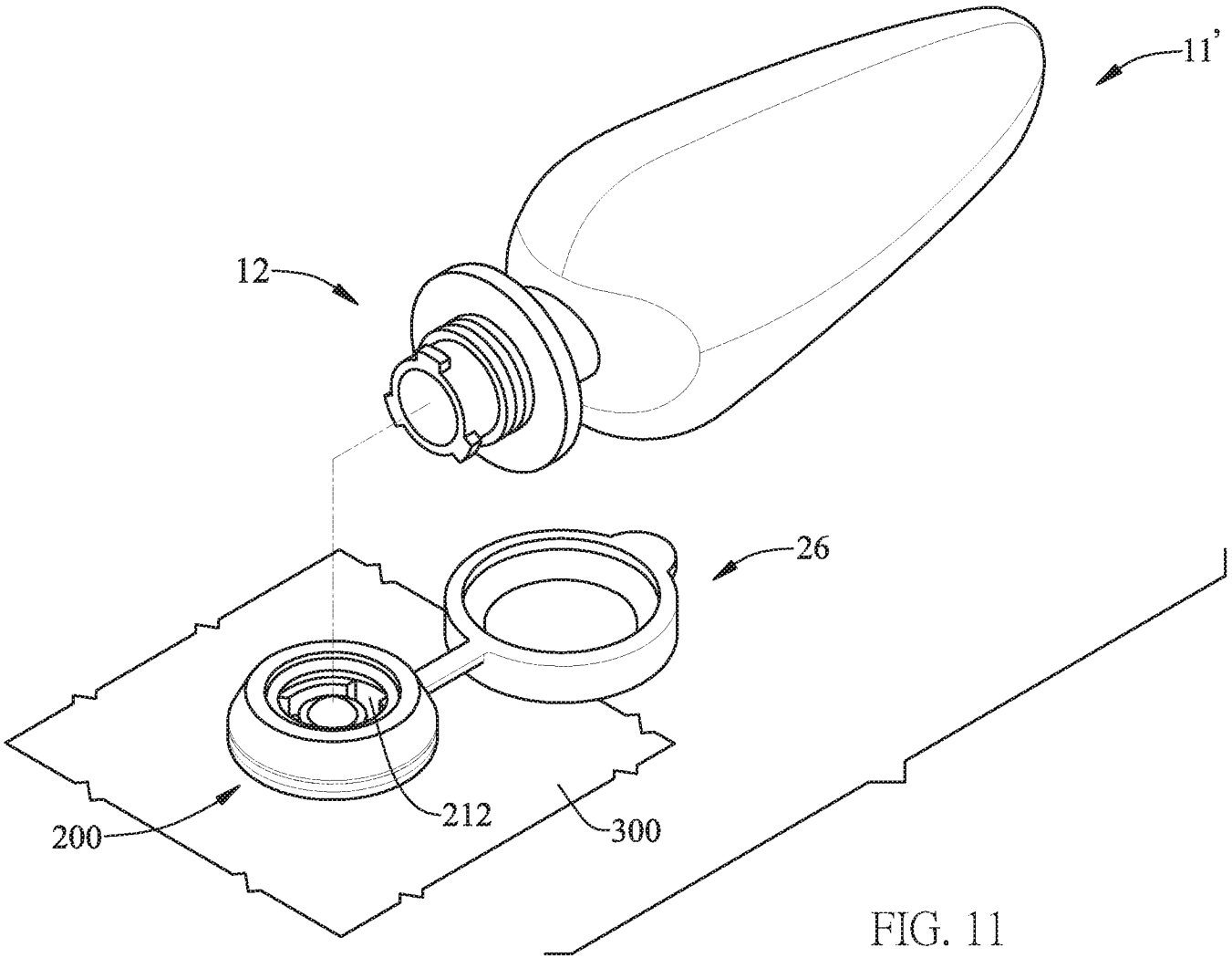
FIG. 11 is an exploded view of a manual pump according to the second embodiment of the present invention.
Figure 12:
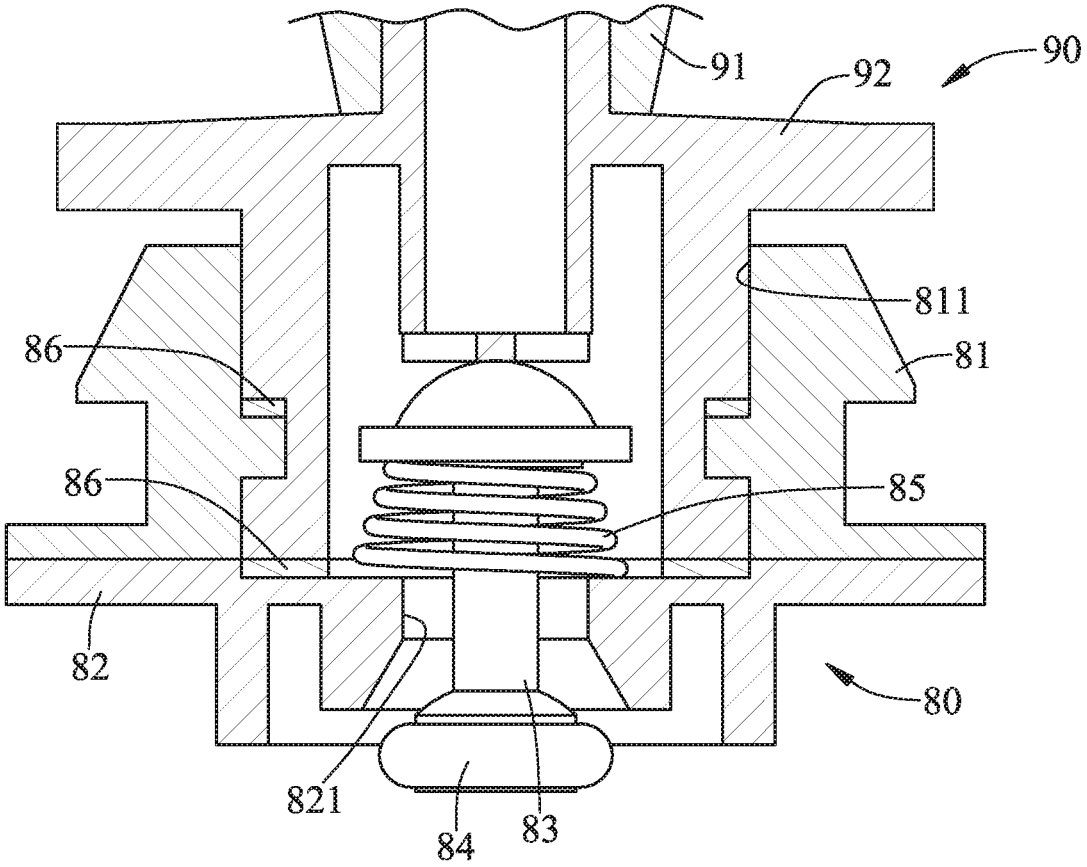
FIG. 12 is an enlarged, partial, cross-sectional view of a conventional manual pump.

Referring to FIG. 11, there is a manual pump according to a second embodiment of the present invention. The second embodiment is identical to the first embodiment except for including a longer air bag 11' instead of the air bag 11. There is a foam material in the air bag 11'. The air bag 11' can be compressed and rolled for storage.

The present invention has been described via the illustration of the embodiments. Those skilled in the art can derive variations from the embodiments without departing from the scope of the present invention. Therefore, the embodiments shall not limit the scope of the present invention defined in the claims.

What is claimed is:

1. A manual pump comprising:

a pumping unit comprising an air bag, a valve housing connected to the air bag, and a sealing ring located on and around the valve housing;

a nozzle unit comprising a shell connected to an inflatable object and made with an opening, a shield connected to the shell and made with an aperture, a plunger inserted in the opening and the aperture, a sealing ring located on and around the plunger, and a spring located on and around the plunger and compressed between the plunger and the shield, wherein the aperture is in air communication with the opening, and the opening comprises a tapered portion with a wall in contact with the sealing ring of the pumping unit when the valve housing is inserted in the shell;

wherein the air bag comprises:

an entrance for admitting air into the air bag; and an exit for receiving a portion of the valve housing so that the air bag is in air communication with the valve housing; and wherein the valve housing comprises:

a connective portion extending in the exit from an end of the valve housing;

a tubular insert extending in the shell from an opposite end of the valve housing; and a pushing tube coaxially extending in the tubular insert.

2. The manual pump according to claim 1, wherein the pumping unit further comprises a check valve inserted in the channel of the connective portion of the valve housing.

3. The manual pump according to claim 1, wherein the valve housing further comprises an annular groove made in an external face of the tubular insert and adapted for receiving the sealing ring of the pumping unit.

4. The manual pump according to claim 1, wherein the valve housing further comprises several arched ribs formed on an external face of the tubular insert, and the shell further comprises several arched grooves made in a wall of the opening and adapted for receiving the arched ribs.

5. The manual pump according to claim 1, wherein the plunger comprises:

a first enlarged end inserted in the tapered portion of the opening and made with a diameter larger than that of the aperture; and a second enlarged end inserted in the aperture and pressed against a wall of the aperture as the spring is compressed between the first enlarged end and the shield.

6. The manual pump according to claim 5, wherein the aperture comprises a tapered portion with a wall in contact with the sealing ring of the nozzle unit.

7. A manual pump comprising:

a pumping unit comprising an air bag, a valve housing connected to the air bag, and a sealing ring located on and around the valve housing;

a nozzle unit comprising a shell connected to an inflatable object and made with an opening, a shield connected to the shell and made with an aperture, a plunger inserted in the opening and the aperture, a sealing ring located on and around the plunger, and a spring located on and around the plunger and compressed between the plunger and the shield, wherein the aperture is in air communication with the opening, and the opening comprises a tapered portion with a wall in contact with the sealing ring of the pumping unit when the valve housing is inserted in the shell;

wherein the air bag comprises:

an entrance for admitting air into the air bag;

an exit for receiving a portion of the valve housing so that the air bag is in air communication with the valve housing; and at least one rectilinear groove extending from an external end of the exit, and the valve housing further comprises at least one rectilinear rib inserted in the rectilinear groove.

8. The manual pump according to claim 7, wherein the air bag further comprises at least one annular groove in communication with an end of the rectilinear groove, and the valve housing further comprises at least one annular rib inserted in the annular groove.

9. The manual pump according to claim 7, wherein the valve housing comprises:

a connective portion extending in the exit from an end of the valve housing;

a tubular insert extending in the shell from an opposite end of the valve housing; and a pushing tube coaxially extending in the tubular insert.

10. The manual pump according to claim 9 wherein the pumping unit further comprises a check valve inserted in the channel of the connective portion of the valve housing.

11. The manual pump according to claim 9, wherein the valve housing further comprises an annular groove made in an external face of the tubular insert and adapted for receiving the sealing ring of the pumping unit.

12. The manual pump according to claim 9, wherein the valve housing further comprises several arched ribs formed on an external face of the tubular insert, and the shell further comprises several arched grooves made in a wall of the opening and adapted for receiving the arched ribs.

13. The manual pump according to claim 9, wherein the plunger comprises:

a first enlarged end inserted in the tapered portion of the opening and made with a diameter larger than that of the aperture; and a second enlarged end inserted in the aperture and pressed against a wall of the aperture as the spring is compressed between the first enlarged end and the shield.

14. The manual pump according to claim 13, wherein the aperture comprises a tapered portion with a wall in contact with the sealing ring of the nozzle unit.

* * * * *